US011946402B2

(12) United States Patent
Shinya et al.

(10) Patent No.: US 11,946,402 B2
(45) Date of Patent: Apr. 2, 2024

(54) WORK VEHICLE

(71) Applicant: Kubota Corporation, Osaka (JP)

(72) Inventors: Masaru Shinya, Osaka (JP); Tatsuya Nishimura, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 17/975,942

(22) Filed: Oct. 28, 2022

(65) Prior Publication Data

US 2023/0184148 A1 Jun. 15, 2023

(30) Foreign Application Priority Data

Sep. 30, 2021 (JP) ..... 2021-162215

(51) Int. Cl.
*F01N 13/08* (2010.01)
*F01N 1/08* (2006.01)

(52) U.S. Cl.
CPC ..... *F01N 13/082* (2013.01); *F01N 1/084* (2013.01); *F01N 2470/24* (2013.01)

(58) Field of Classification Search
CPC . F01N 1/14; F01N 3/05; F01N 13/082; F01N 13/20; F01N 2270/08; F01N 2470/24
See application file for complete search history.

(56) References Cited

U.S. PATENT DOCUMENTS

2010/0000205 A1* 1/2010 Freese, V ..... F01N 13/082 60/320
2012/0145268 A1 6/2012 Clarke et al.
2013/0205759 A1 8/2013 Gardner et al.
2014/0020638 A1 1/2014 Park
2022/0203314 A1* 6/2022 Mitsui ..... F01N 13/082

FOREIGN PATENT DOCUMENTS

DE 102009046253 A1 5/2011
GB 2513187 A * 10/2014 ..... F01N 13/082
JP 2006200445 A * 8/2006
JP 2016-153304 A 8/2016
JP 2019214964 A * 12/2019
JP 2022102298 A 7/2022
KR 20110032683 A * 3/2011

OTHER PUBLICATIONS

Machine translation of KR-20110032683-A, accessed Sep. 20, 2023. (Year: 2023).*
Extended European Search Report issued in corresponding European Patent Application 22203935.6 dated Mar. 30, 2023 (9 pages).

* cited by examiner

*Primary Examiner* — Jonathan R Matthias
(74) *Attorney, Agent, or Firm* — Osha Bergman Watanabe & Burton LLP

(57) ABSTRACT

A work vehicle includes: a first exhaust pipe to which engine exhaust is sent; and a second exhaust pipe that has an inlet having an outer diameter larger than an outlet of the first exhaust pipe, the outlet of the first exhaust pipe and the inlet of the second exhaust pipe being disposed in proximity such that the outlet of the first exhaust pipe is positioned inside the inlet of the second exhaust pipe; a partition that divides a cross section of the outlet of the first exhaust pipe into a plurality of divided regions when viewed from the flow direction and partitions the adjacent divided regions at intervals.

11 Claims, 6 Drawing Sheets

WORK VEHICLE

BACKGROUND

Technical Field

The present invention relates to a configuration of an engine exhaust in a work vehicle.

Description of Related Art

For example, among work vehicles such as tractors used in orchards, livestock barns, and the like, in some work vehicles provided with an engine, a muffler is provided at a lower portion of the mechanical body due to restrictions on the height of the mechanical body, or the like. In these cases, in use environments such as orchards and livestock barns, combustibles such as fallen leaves may accumulate on the ground, so there is a demand to lower the temperature of the engine exhaust discharged from the muffler.

A tractor, which is an example of a work vehicle, may be provided with a configuration as disclosed in patent literature 1 as a configuration for lowering the temperature of engine exhaust.

In patent literature 1, a first exhaust pipe from which engine exhaust is sent and a second exhaust pipe provided with an inlet having a larger outer diameter than an outlet of the first exhaust pipe are provided, wherein the outlet of the first exhaust pipe and the inlet of the second exhaust pipe are disposed in proximity such that the outlet of the first exhaust pipe is disposed in the interior of the inlet of the second exhaust pipe.

When engine exhaust exits from the outlet of the first exhaust pipe and enters the interior of the second exhaust pipe from the inlet of the second exhaust pipe, outside air is drawn into the flow of the engine exhaust due to an ejector effect, brought into the interior of the second exhaust pipe from the inlet of the second exhaust pipe, and mixes with the engine exhaust. The temperature of the engine exhaust is thereby lowered by the outside air.

PRIOR ART LITERATURE

[Patent Literature 1] JP 2016-153304 A

In the above configuration, in order to bring in a large amount of outside air in order to lower the temperature of the engine exhaust, it is required to increase the flow speed of the engine exhaust at the outlet of the first exhaust pipe, and for the outlet of the first exhaust pipe, it is required to increase a portion (boundary surface) where the engine exhaust flow contacts the outside air.

In patent literature 1, in order to increase the flow speed of the engine exhaust at the outlet of the first exhaust pipe, the outlet of the first exhaust pipe is squeezed to a flat shape to increase the flow speed of the engine exhaust. However, if the outlet of the first exhaust pipe is squeezed too much, the disadvantage of increased engine exhaust back pressure increases.

In order to increase the portion (boundary surface) where the engine exhaust flow contacts the outside air, increasing the diameters of the outlet of the first exhaust pipe and the inlet of the second exhaust pipe, and providing many configurations wherein the outlet of the first exhaust pipe and the inlet of the second exhaust pipe are disposed in proximity are considered, but these lead to larger or more complicated structures.

SUMMARY

One or more embodiments of the present invention configure a work vehicle so that when the outlet of the first exhaust pipe and the inlet of the second exhaust pipe are disposed in proximity, the temperature of the engine exhaust may be lowered by a large amount of outside air being drawn into the flow of engine exhaust and mixed into the engine exhaust without squeezing the outlet of the first exhaust pipe more than necessary.

The work vehicle of one or more embodiments is provided with a first exhaust pipe to which engine exhaust is sent, and a second exhaust pipe that has an inlet having an outer diameter larger than an outer diameter of an outlet of the first exhaust pipe, wherein the outlet of the first exhaust pipe and the inlet of the second exhaust pipe are disposed in proximity such that the outlet of the first exhaust pipe is positioned inside the inlet of the second exhaust pipe, and, a partition that divides a cross section of the outlet of the first exhaust pipe into a plurality of divided regions when viewed from the flow direction and partitions the adjacent divided regions at intervals.

According to this, in a configuration wherein the outlet of the first exhaust pipe and the inlet of the second exhaust pipe are disposed in proximity such that the outlet of the first exhaust pipe is disposed inside the inlet of the second exhaust pipe, the region of the outlet of the first exhaust pipe is divided into a plurality of divided regions by a partition and the adjacent divided regions are partitioned at intervals by the partition.

According to this, when the engine exhaust is discharged from the outlet of the first exhaust pipe, the flow of the engine exhaust is divided into a plurality of flows corresponding to the divided regions while passing through the plurality of divided regions due to the partition. Immediately after the partition, the plurality of flows of engine exhaust become independent flows, and after this, the plurality of flows of the engine exhaust are mixed with outside air and then converge. At the same time, because the region of the outlet of the first exhaust pipe is narrowed by the partition, the flow speed of the plurality of flows of engine exhaust is increased.

According to this, in each of the plurality of flows of engine exhaust, the peripheral part of the divided region serves as the boundary surface, and thus, the sum of boundary surfaces of the plurality of flows of engine exhaust becomes the boundary surface of the engine exhaust when the partition is provided.

In contrast, the boundary surface of the engine exhaust when the partition is not provided is the peripheral part of the outlet of the first exhaust pipe.

Therefore, the boundary surface of engine exhaust when the partition is provided is larger than the boundary surface of the engine exhaust when the partition is not provided.

As described above, according to one or more embodiments, by providing the partition, it is possible to increase the boundary surface of the engine exhaust while increasing the flow speed of the engine exhaust appropriately, and thus, it is possible to configure so that a large amount of outside air is drawn into the flow of engine exhaust, introduced into the interior of the second exhaust pipe from the inlet of the second exhaust pipe, and mixed with the engine exhaust, so that and the temperature of the engine exhaust can be reduced.

In one or more embodiments, it is suitable that the partition is attached to the outlet of the first exhaust pipe.

According to this, at the outlet of the first exhaust pipe, the partition is attached across one portion of the peripheral part and another portion of the peripheral part of the outlet, and therefore the outlet of the first exhaust pipe is reinforced by the partition.

In one or more embodiments, it is suitable that the partition is formed such that the areas of the plurality of divided regions are all the same when viewed from the flow direction.

According to this, when the flow of engine exhaust is divided into a plurality of flows by the partition as described above, the areas of the plurality of divided regions due to the partition are all the same, and the boundary surfaces of each of the plurality of flows of engine exhaust are substantially the same, and therefore, outside air can be expected to mix in each of the plurality of flows of engine exhaust substantially evenly and the temperatures of the engine exhaust of each of the plurality of flows of engine exhaust can be expected to decrease substantially evenly.

Thus, when the flows of the engine exhaust converge after being divided into a plurality of flows by the partition, it can be expected that the temperature of the engine exhaust will decrease substantially evenly.

In one or more embodiments, it is suitable that the partition extends radially outward from a center of the outlet of the first exhaust pipe when viewed from the flow direction.

According to this, since the partition is disposed and formed radially, it is possible to form the partition in a simple manner while giving the partition sufficient strength.

In one or more embodiments, it is suitable that the partition is made of a flat plate having a plurality of openings.

According to this, since the partition is formed in a flat shape with a plurality of opening, it is possible to form the partition in a simple manner while giving the partition sufficient strength.

In one or more embodiments, it is suitable that the partition is line symmetrical with respect to a virtual straight line passing through the center of the outlet of the first exhaust pipe when viewed from the flow direction.

According to this, it can be expected that the temperature of the engine exhaust will be reduced substantially evenly due to the outside air mixing with the engine exhaust along the line-symmetrical partition.

The work vehicle of one or more embodiments is provided with a first exhaust pipe to which engine exhaust is sent, and a second exhaust pipe that has an inlet having an outer diameter larger than an outer diameter of the outlet of the first exhaust pipe, wherein the outlet of the first exhaust pipe and the inlet of the second exhaust pipe are disposed in proximity such that the outlet of the first exhaust pipe is positioned inside the inlet of the second exhaust pipe, and a notch part extending from an end of the outlet of the first exhaust pipe toward a direction opposite to the second exhaust pipe and is formed on a peripheral part of outlet of the first exhaust pipe.

According to this, in a configuration wherein the outlet of the first exhaust pipe and the inlet of the second exhaust pipe are disposed in proximity such that the outlet of the first exhaust pipe is disposed inside the inlet of the second exhaust pipe, a notch part is formed on the peripheral part of the outlet of the first exhaust pipe so as to extend from the end of the outlet of the first exhaust pipe to the direction opposite to the second exhaust pipe.

According to this, when the engine exhaust is discharged from the outlet of the first exhaust pipe, the engine exhaust is also discharged from the notch part, so the peripheral part of the notch part also serves as the boundary surface. In this case, the peripheral part of the notch part is long due to the notch part extending from the end of the outlet of the first exhaust pipe to the direction opposite to the second exhaust pipe.

In contrast, the boundary surface of the engine exhaust when the notch part is not provided is the peripheral part of the outlet of the first exhaust pipe.

Therefore, the boundary surface of engine exhaust when the notch part is provided is larger than the boundary surface of the engine exhaust when the notch part is not provided.

As described above, according to one or more embodiments, by providing the notch part, it is possible to increase the boundary surface of the engine, and thus, it is possible to configure so that a large amount of outside air is drawn into the flow of engine exhaust, introduced into the interior of the second exhaust pipe from the inlet of the second exhaust pipe, and mixed with the engine exhaust, so that the temperature of the engine exhaust can be reduced.

In one or more embodiments, it is suitable that the notch part includes a plurality of notches formed all around the peripheral part of the outlet of the first exhaust pipe.

According to this, the peripheral part of the notch part serving as the boundary surface is increased, and therefore, the boundary surface of the engine exhaust when a notch part is provided can be further increased. Since the plurality of notch parts is formed across the entire periphery of the peripheral part of the outlet of the first exhaust pipe, the boundary surface is substantially evenly increased across the entire periphery of the peripheral part of the outlet of the first exhaust pipe. Thus, it can be expected that outside air will be mixed in from the entire periphery of the flow of engine exhaust substantially evenly and it can be expected that the temperature of the engine exhaust will be reduced substantially evenly.

In one or more embodiments, it is suitable that the notch part is line symmetrical with respect to a virtual straight line passing through the center of the outlet of the first exhaust pipe when viewed from the flow direction.

According to this, it can be expected that the temperature of the engine exhaust will be reduced substantially evenly due to the outside air mixing with the engine exhaust along the line-symmetrical notch part.

The work vehicle of one or more embodiments is provided with a first exhaust pipe to which engine exhaust is sent, and a second exhaust pipe that has an inlet having an outer diameter larger than an outer diameter of the outlet of the first exhaust pipe, wherein the outlet of the first exhaust pipe and the inlet of the second exhaust pipe are disposed in proximity such that the outlet of the first exhaust pipe is positioned inside the inlet of the second exhaust pipe, a partition that divides a cross section of the outlet of the first exhaust pipe into a plurality of divided regions when viewed from the flow direction and partitions the adjacent divided regions at intervals, and a notch part extending from an end of the outlet of the first exhaust pipe to the direction opposite to the second exhaust pipe and is formed on the peripheral part of the outlet of the first exhaust pipe.

According to this, in a configuration wherein the outlet of the first exhaust pipe and the inlet of the second exhaust pipe are disposed in proximity such that the outlet of the first exhaust pipe is disposed inside the inlet of the second exhaust pipe, the region of the outlet of the first exhaust pipe is divided into a plurality of divided regions by a partition and the adjacent divided regions are partitioned at intervals by the partition. A notch part is formed on the peripheral part of outlet of the first exhaust pipe so as to extend from the end of the outlet of the first exhaust pipe to the direction opposite to the second exhaust pipe.

According to this, when the engine exhaust is discharged from the outlet of the first exhaust pipe, the flow of the engine exhaust is divided into a plurality of flows corresponding to the divided regions while passing through the plurality of divided regions due to the partition. Immediately after the partition, the plurality of flows of engine exhaust become independent flows, and after this, the plurality of flows of the engine exhaust are mixed with outside air and then converge. At the same time, because the region of the outlet of the first exhaust pipe is narrowed by the partition, the flow speed of the plurality of flows of engine exhaust is increased. When the engine exhaust is discharged from the outlet of the first exhaust pipe, the engine exhaust is also discharged from the notch part.

According to this, in each of the plurality of flows of engine exhaust, the peripheral part of the divided region serves as the boundary surface, and thus, the sum of boundary surfaces of the plurality of flows of engine exhaust becomes the boundary surface of the engine exhaust when the partition is provided.

When the engine exhaust is discharged from the outlet of the first exhaust pipe, the engine exhaust is also discharged from the notch part, so the peripheral part of the notch part also serves as the boundary surface. In this case, the peripheral part of the notch part is long due to the notch part extending from the end of the outlet of the first exhaust pipe to the direction opposite to the second exhaust pipe.

According to one or more embodiments, the boundary surface of engine exhaust when the partition is provided and the boundary surface of the engine exhaust when the notch part is provided are summed.

In contrast, the boundary surface of the engine exhaust when the partition and notch part are not provided is the peripheral part of the outlet of the first exhaust pipe.

Therefore, the boundary surface of engine exhaust when the partition and notch part are provided is larger than the boundary surface of the engine exhaust when the partition and notch part are not provided.

As described above, according to one or more embodiments, by providing the partition and notch part, it is possible to increase the boundary surface of the engine exhaust while increasing the flow speed of the engine exhaust appropriately, and thus, it is possible to configure so that a large amount of outside air is drawn into the flow of engine exhaust, introduced into the interior of the second exhaust pipe from the inlet of the second exhaust pipe, and mixed with the engine exhaust, so that and the temperature of the engine exhaust can be reduced.

In one or more embodiments, it is suitable that the partition is attached on the first exhaust pipe across a portion further separated to the direction opposite to the second exhaust pipe than the end of the notch part in the direction opposite to the second exhaust pipe, and the end of the outlet of the first exhaust pipe, and that the partition protrudes from the end of the outlet of the first exhaust pipe toward the second exhaust pipe.

According to this, the partition formed in a long shape in the flow direction, and therefore, when the flow of engine exhaust is divided into a plurality of flows by the partition as described above, the plurality of flows of engine exhaust each easily become independent flows. This is advantageous in that the peripheral parts of the divided regions of each of the plurality of flows of engine exhaust serve as the boundary surface.

In one or more embodiments, it is suitable that the partition and the notch part are line symmetrical with respect to a virtual straight line passing through the center of the outlet of the first exhaust pipe when viewed from the flow section.

According to this, it can be expected that the temperature of the engine exhaust will be reduced substantially evenly due to the outside air mixing with the engine exhaust along the line-symmetrical partition and notch part.

In one or more embodiments, it is suitable that a cross section of the partition has a wedge shape when viewed from a direction orthogonal to the flow direction, the wedge shape tapering toward an upstream of a flow of the exhaust discharged from the outlet of the first exhaust pipe.

According to this, when the flow of engine exhaust is divided into a plurality of divided regions by the partition, the cross-sectional shape of the partition is wedge-shaped, and therefore, the flow of engine exhaust is guided along the partition, spaces in which engine exhaust cannot flow in regions downstream of the partition are more easily generated, and these spaces are more easily expanded further downstream. Thus, because the outside air is more easily mixed into a space wherein the engine exhaust cannot flow, it can be expected that the temperature of the engine exhaust is efficiently decreased.

DETAILED DESCRIPTION OF EMBODIMENTS

FIGS. 1 to 9 illustrate a tractor that is an example of a work vehicle, wherein F shows a forward direction, B shows a backward direction, U shows an upward direction, and D shows a downward direction.

(Overall Configuration of Tractor)

Figure 1:
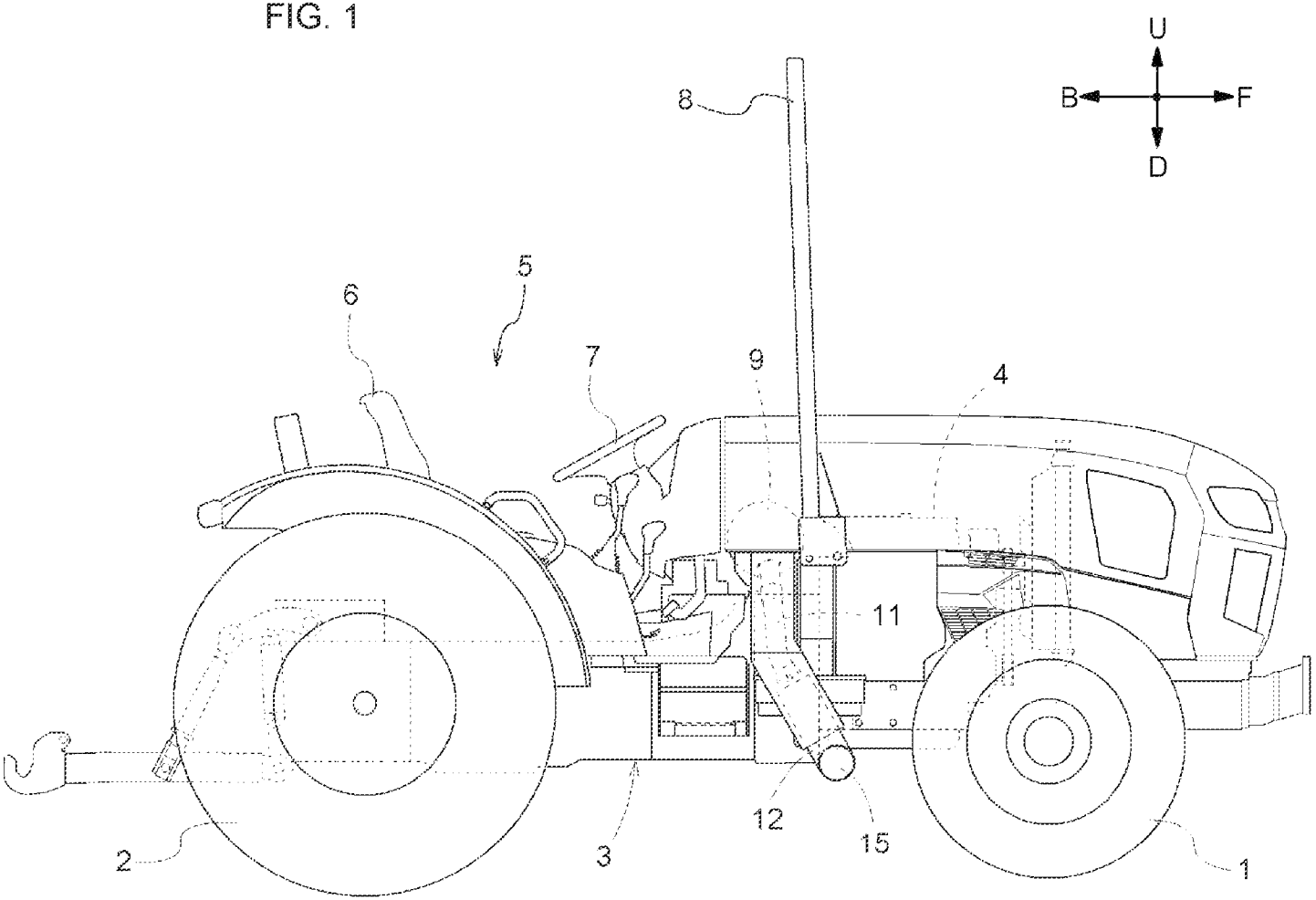
FIG. 1 is a side view of a tractor.

As illustrated in FIG. 1, a mechanical body 3 is supported by right and left front wheels 1 and right and left rear wheels 2. A diesel-type engine 4 is provided at a front portion of the mechanical body 3, a driving unit 5 is provided at back portion of the mechanical body 3, and a driver's seat 6 and a steering wheel 7 for the front wheels 1 are provided in the driving unit 5. An arch-shaped ROPS frame 8 is provided between the engine 4 and the driving unit 5.

Figure 2:
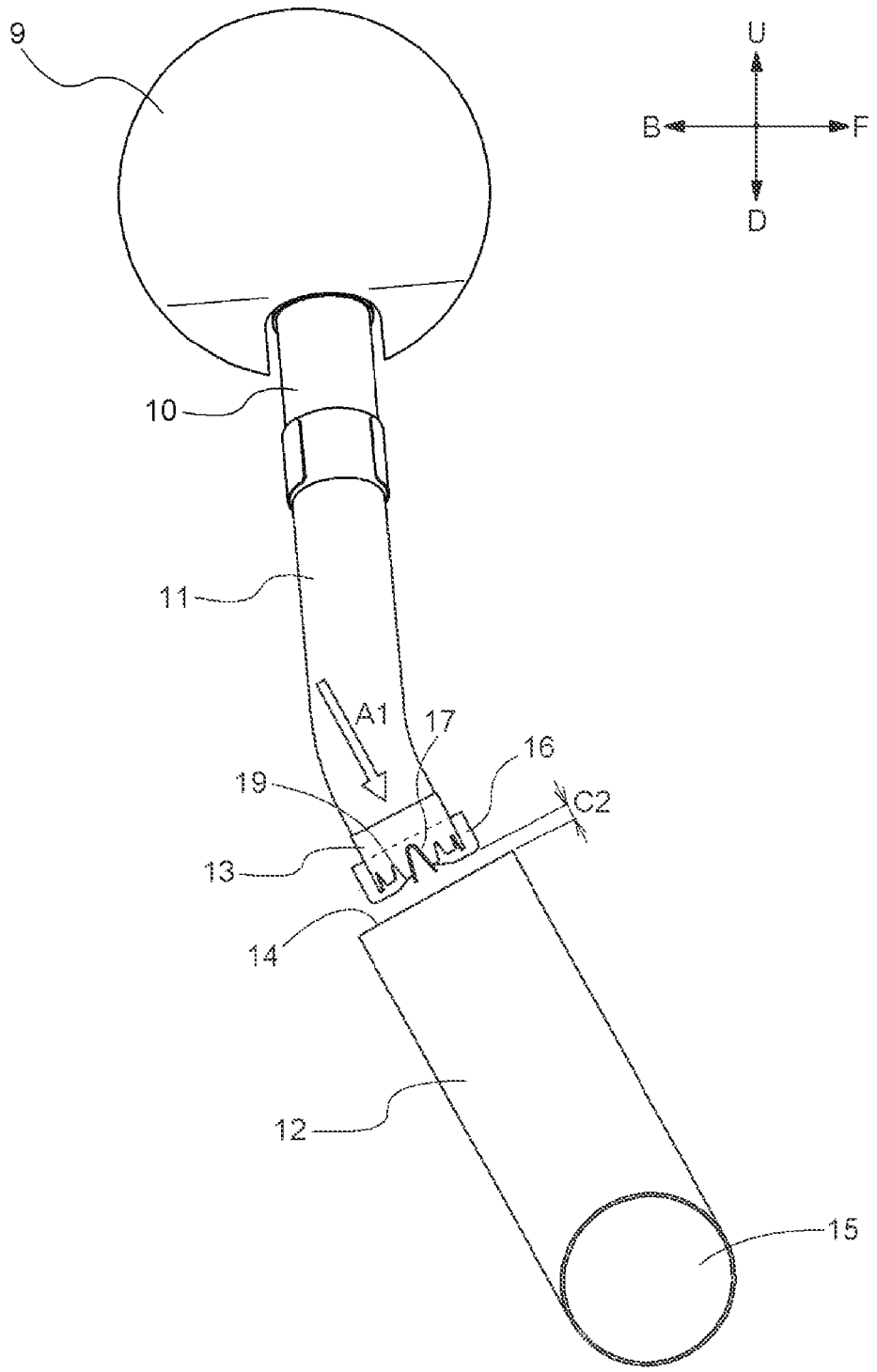
FIG. 2 is a side view in the vicinity of an exhaust purification device, a first exhaust pipe, and a second exhaust pipe.

(Disposition of the First Exhaust Pipe and Second Exhaust Pipe) As illustrated in FIGS. 1 and 2, exhaust of the engine 4 is fed to an exhaust purification device (not illustrated) (DPF) to remove particulates from the exhaust of the engine 4. Next, the exhaust of the engine 4 is fed from the exhaust purification device (DPF) to an exhaust purification device 9 (SCR), and nitrogen oxide is removed from the exhaust of the engine 4.

The exhaust purification device 9 is disposed along the horizontal or left-right direction between the engine 4 and the driving unit 5 (steering wheel 7), and a round pipe shaped exhaust pipe 10 is extended downward from a right portion of the engine purification device 9. A round pipe shaped first exhaust pipe 11 is connected to the exhaust pipe 10 and extended downward, and a round pipe shaped second exhaust pipe 12 is supported along the vertical or up-down direction on the bottom of the first exhaust pipe 11.

With the above configuration, the exhaust of the engine 4 is fed from the exhaust purification device (not illustrated) (DPF) to the exhaust purification device 9 (SCR) and sent from the exhaust pipe 10 to the first exhaust pipe 11, sent from an outlet 13 of a lower portion of the first exhaust pipe 11 to an inlet 14 of an upper portion of the second exhaust pipe 12 and discharged from an outlet 15 of a lower portion of the second exhaust pipe 12.

(Configuration of the Notch Parts Formed on the Outlet of the First Exhaust Pipe)

Figure 4:
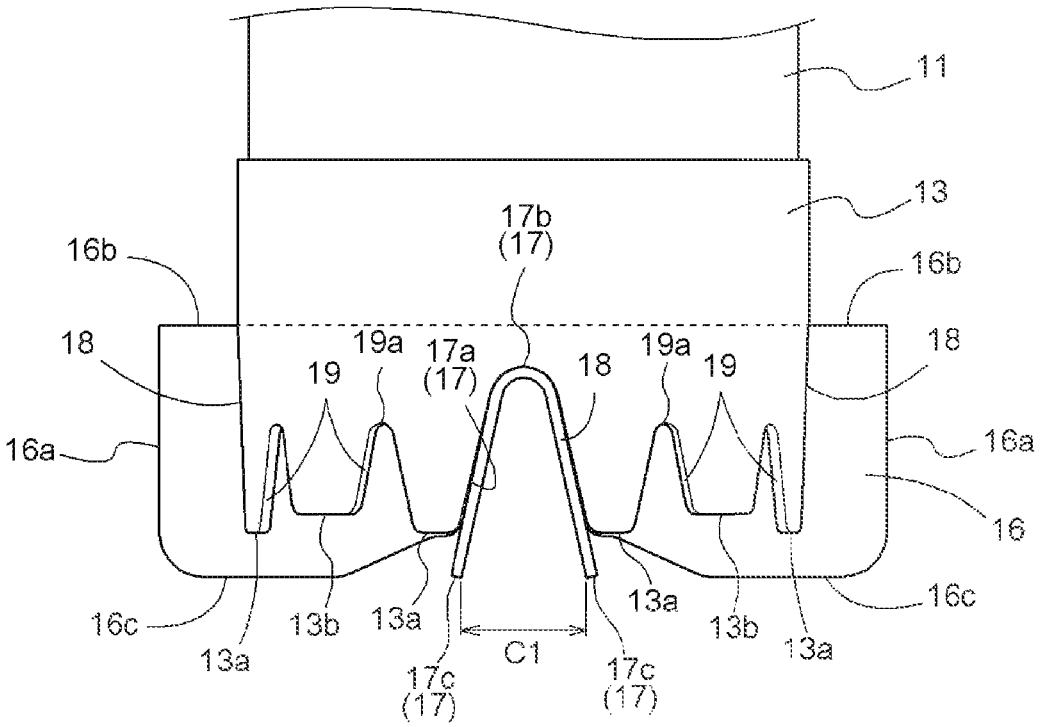
FIG. 4 is a side view of the vicinity of an outlet of a first exhaust pipe and a partition.
Figure 5:
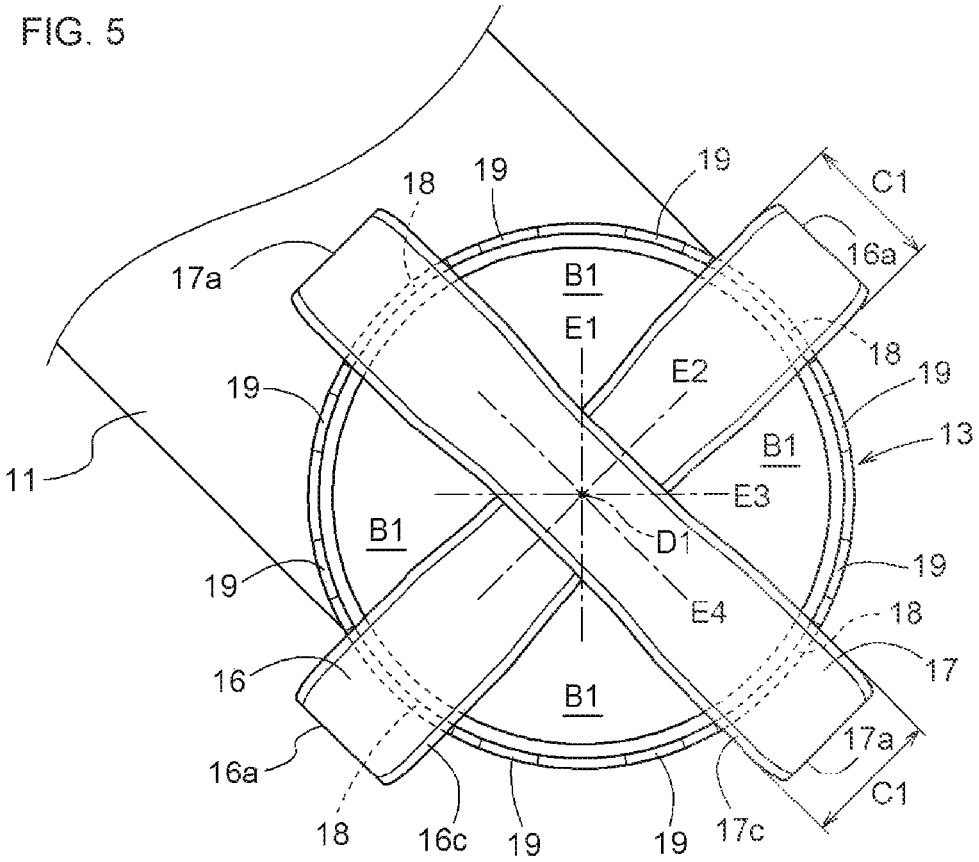
FIG. 5 is a bottom view of the vicinity of an outlet of a first exhaust pipe and a partition.

As illustrated in FIGS. 4 and 5, four triangular notch parts 18 are formed at intervals of 90 degrees on a peripheral part of the outlet 13 of the first exhaust pipe 11.

At the peripheral part of the outlet 13 of the first exhaust pipe 11, two triangular notch parts 19 smaller than the notch parts 18 are formed on each of the four portions between the adjacent notch parts 18, forming a total of eight notch parts 19. A plurality of notch parts 19 are thereby formed across the entire periphery of the peripheral port of the outlet 13 of the first exhaust pipe 11.

The notch parts 18, 19 are formed with point symmetry with respect to a center D1 of the outlet 13 of the first exhaust pipe 11 seen from the direction A1 of the flow of exhaust discharged from the outlet 13 of the first exhaust pipe 11 (see FIG. 2).

Figure 6:
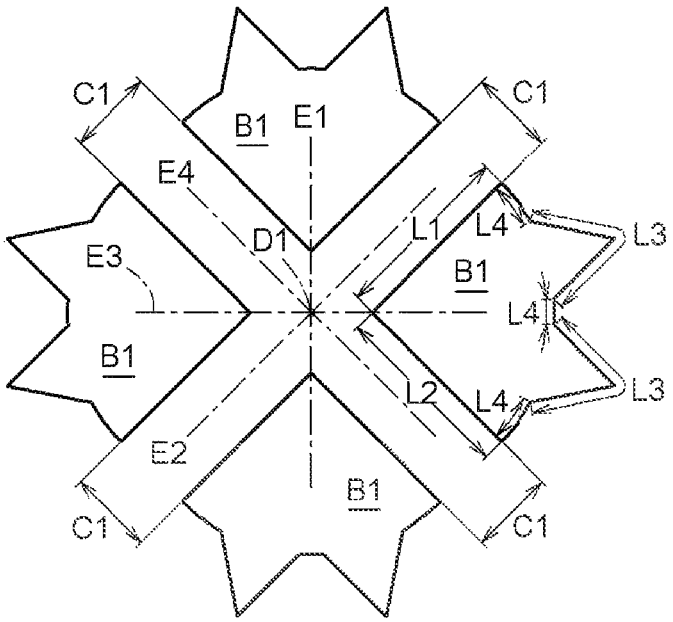
FIG. 6 is a schematic diagram illustrating divided regions.

As illustrated in FIGS. 5 and 6, when imagining virtual straight lines E1, E2, E3, E4 passing through the center D1 of the outlet 13 of the first exhaust pipe 11 seen from the direction A1 of the flow of exhaust discharged from the outlet 13 of the first exhaust pipe 11 (see FIG. 2), the notch parts 19 are formed with line symmetry with respect to virtual straight lines E1, E2, E3, E4.

Notch parts 18, 19 are formed to extend upward from end parts 13*a*, 13*b* of the outlet 13 of the first exhaust pipe 11 (opposite side of the second exhaust pipe 12). Regarding end parts 13*a*, 13*b* of the outlet 13 of the first exhaust pipe 11, the end part 13*a* adjacent to the notch parts 18 extends farther downward (to the second exhaust pipe 12 side) than the end part 13*b* between notch parts 19.

(Configuration of a Partition Provided at the Outlet of the First Exhaust Pipe)

Figure 3:
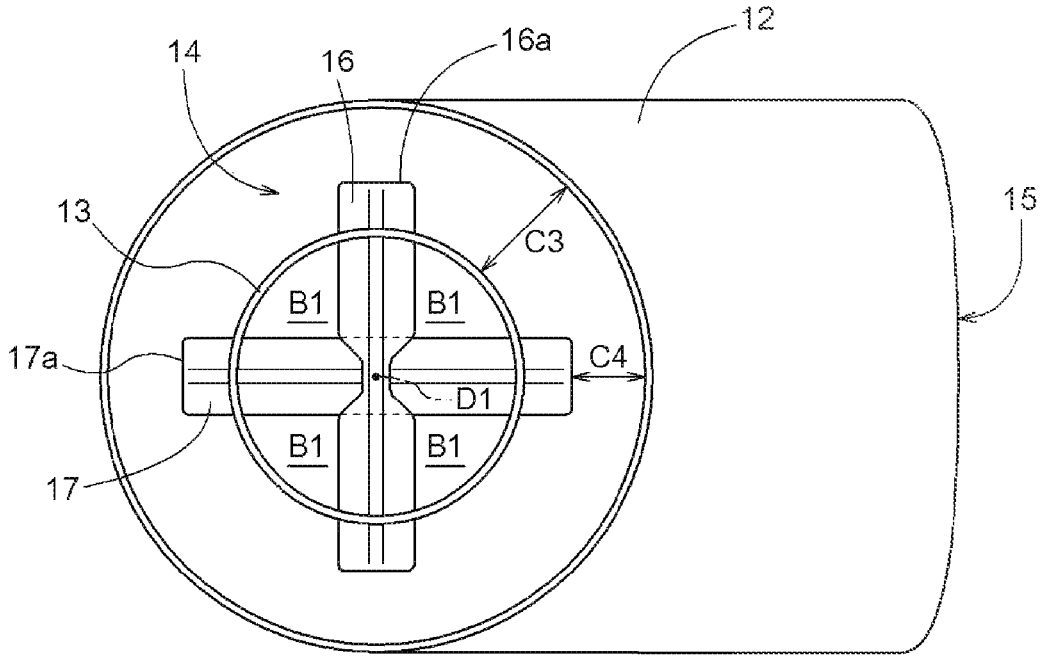
FIG. 3 is a plan view of the vicinity of an outlet of a first exhaust pipe, an inlet of a second exhaust pipe, and a partition.

As illustrated in FIGS. 3, 4, and 5, a plate material is folded into a triangular cross-section to form partitions 16, 17 and the partitions 16, 17 are combined so as to cross orthogonally and connect to each other. The partitions 16, 17 are inserted into the notch parts 18 of the outlet 13 of the first exhaust pipe 11 and attached to the outlet 13 of the first exhaust pipe 11.

Seen from the direction A1 of the flow of exhaust discharged from the outlet 13 of the first exhaust pipe 11 (see FIG. 2), the orthogonally crossing portions of the partitions 16, 17 are disposed at the center of the outlet 13 of the first exhaust pipe 11. Seen from the direction A1 of the flow of exhaust discharged from the outlet 13 of the first exhaust pipe 11, the partitions 16, 17 are disposed and formed radially facing outward from the center of the outlet 13 of the first exhaust pipe 11.

Due to the partitions 16, 17 being formed by the plate material being bent to have a triangular cross-section, seen from the direction orthogonal to the direction A1 (see FIG. 2) of the flow of exhaust discharged from the outlet 13 of the first exhaust pipe 11 (see FIG. 4), the cross-sectional shape of the partitions 16, 17 is formed in a wedge shape tapering upstream of the flow of exhaust discharged from the outlet 13 of the first exhaust pipe 11.

The partitions 16, 17 are formed with point symmetry with respect to the center D1 of the outlet 13 of the first exhaust pipe 11 seen from the direction A1 of the flow of exhaust discharged from the outlet 13 of the first exhaust pipe 11 (see FIG. 2).

As illustrated in FIGS. 5 and 6, when imagining virtual straight lines E1, E2, E3, E4 passing through the center D1 of the outlet 13 of the first exhaust pipe 11 seen from the direction A1 of the flow of exhaust discharged from the outlet 13 of the first exhaust pipe 11 (see FIG. 2), the partitions 16, 17 are formed with line symmetry with respect to virtual straight lines E1, E2, E3, E4.

Even in a configuration in which the partitions 16, 17 and the notch part 19 are combined, the configuration in which the partitions 16, 17 and the notch part 19 are combined is formed with line symmetry with respect to the virtual straight lines E1, E2, E3, E4.

Outer ends 16*a*, 17*a* of the partitions 16, 17 protrude radially outward from the outer peripheral portion of the outlet 13 of the first exhaust pipe 11. The upper end parts 16*b*, 17*b* of the partitions 16, 17 are positioned above the upper end part 19*a* of the notch part 19 (opposite side of the second exhaust pipe 12) (see FIG. 4), and the lower end parts 16*c*, 17*c* of the partitions 16, 17 protrude downward from the end parts 13*a*, 13*b* of the outlet 13 of the first exhaust pipe 11 (to the second exhaust pipe 12 side) (see FIG. 4).

Thus, the partitions 16, 17 are attached on the first exhaust pipe across a portion further separated on the opposite side of the second exhaust pipe 12 than the end part 19*a* of the opposite side of the second exhaust pipe 12 of the notch part 19, and the end part 13*a* of the outlet 13 of the first exhaust pipe 11, and the partitions 16, 17 protrude from the end parts 13*a*, 13*b* of the outlet 13 of the first exhaust pipe 11 towards the second exhaust pipe 12 side.

(Relationship Between the Partitions and Notch Parts and the Outlet of the First Exhaust Pipe) As illustrated in FIGS. 5 and 6, seen from the direction A1 of the flow of exhaust discharged from the outlet 13 of the first exhaust pipe 11 (see FIG. 2), the region of the outlet 13 of the first exhaust pipe 11 is divided by the partitions 16, 17 into four divided regions B1. A region of the notch part 19 is also included in the four divided regions B1, and the adjacent divided regions B1 are partitioned by the partitions 16, 17 with intervals C1 of the width of the partitions 16, 17.

Thus, seen from the direction A1 (see FIG. 2) of the flow of exhaust discharged from the outlet 13 of the first exhaust pipe 11, the areas of the four divided regions B1 are all the same.

When exhaust of the engine 4 is sent to the first exhaust pipe 11, the exhaust of the engine 4 is divided into four flows corresponding to the divided regions B1 at the outlet 13 of the first exhaust pipe 11 while passing through the divided regions B1 due to the partitions 16, 17. Immediately after the partitions 16, 17, the four flows of exhaust of the engine 4 become independent flows, and after this, the four flows of exhaust of the engine 4 are mixed with outside air and then converge.

At the same time, the cross-sectional shape of the partitions 16, 17 is formed in a wedge shape that tapers upstream of the flow of the exhaust discharged from the outlet 13 of the first exhaust pipe 11, and thus, the region of the outlet 13 of the first exhaust pipe 11 is narrowed by the partitions 16, 17 and flow of the exhaust of the engine 4 is obstructed by the partition 16, 17, causing the flow speed of the four flows of exhaust of the engine 4 to increase. A negative pressure space in which exhaust of the engine 4 cannot flow is more easily generated in the region downstream of the partitions 16, 17, and this negative pressure space is more easily expanded downstream.

In the flow corresponding to the divided regions B1 of the exhaust of the engine 4, the boundary surface, which is the portions at which the flow of exhaust of the engine 4 contacts outside air, is the sum of a portion L1 corresponding to the lower end part 16*c* of the partition 16, a portion L2 corresponding to the lower end part 17*c* of the partition 17, two portions L3 corresponding to the peripheral parts of the two notch parts 19, and three portions L4 corresponding to end parts 13*a*, 13*b* of the outlet 13 of the first exhaust pipe 11.

Thus, the boundary surface when the partitions 16, 17 and the notch parts 19 are provided is the sum of the boundary surfaces of the four flows corresponding to the divided regions B1 of the exhaust of the engine 4.

(Relationship Between the First Exhaust Pipe and the Second Exhaust Pipe)

As illustrated in FIG. 3, the second exhaust pipe 12 is formed to have a larger diameter than the first exhaust pipe 11, and the inlet 14 of the second exhaust pipe 12 is formed to have a larger outer diameter than the outlet 13 of the first exhaust pipe 11. The outlet 15 of the second exhaust pipe 12 is formed so as to face laterally outward to the right from the mechanical body 3.

As illustrated in FIG. 2, in a side view (direction orthogonal to the direction A1 of the flow exhaust discharged from the outlet 13 of the first exhaust pipe 11), the outlet 13 of the first exhaust pipe 11 and the inlet 14 of the second exhaust pipe 12 are disposed in proximity such that the outlet of the first exhaust pipe 11 (end parts 16*c*, 17*c* of the partitions 16, 17) and the outlet 14 of the second exhaust pipe 12 are disposed at small intervals C2.

As illustrated in FIG. 3, seen from the direction A1 of the flow of exhaust discharged from the outlet 13 of the first exhaust pipe 11 (see FIG. 2), the outlet 13 of the first exhaust pipe 11 and the partitions 16, 17 are disposed in the interior of the inlet 14 of the second exhaust pipe 12.

The peripheral part of the outlet 13 of the first exhaust pipe 11 and the peripheral part of the inlet 14 of the second exhaust pipe 12 are disposed at intervals C3. The outer end parts 16*a*, 17*a* of the partitions 16, 17 and the peripheral part of the inlet 14 of the second exhaust pipe 12 are disposed at intervals C4 narrower than the intervals C3.

With the above configuration, the exhaust of the engine 4 is discharged from the outlet 13 of the first exhaust pipe 11, is sent to the inlet 14 of the second exhaust pipe 12, enters the interior of the second exhaust pipe 12, and is exhausted from the outlet 15 of the lower portion of the second exhaust pipe 12.

As described above (relationship between the partitions and notch parts and the outlet of the first exhaust pipe), by providing the partitions 16, 17 and notch parts 19, the flow speed of exhaust of the engine 4 can be appropriately increased.

A negative pressure space in which exhaust of the engine 4 cannot flow is more easily generated in the region downstream of the partitions 16, 17, and outside air more easily mixes in this negative pressure space.

The boundary surface when the partitions 16, 17 and the notch parts 19 are provided is the sum of the boundary surfaces of the four flows corresponding to the divided regions B1 of the exhaust of the engine 4.

Thus, a large amount of outside air is drawn into the flow of exhaust of the engine 4, brought into the interior of the second exhaust pipe 12 from between the peripheral part of the outlet 13 of the first exhaust pipe 11 and the inlet 14 of the second exhaust pipe 12, mixed into the exhaust of the engine 4, and the temperature of the exhaust of the engine 4 is lowered.

(First Alternative Mode)

In the configuration illustrated in FIGS. 2 to 5, the notch part 19 may be removed.

In a side view, in order to overlap the outlet 13 of the first exhaust pipe 11 and the inlet 14 of the second exhaust pipe 12, the outlet 13 of the first exhaust pipe 11 may be disposed along the direction A1 (see FIG. 2) of the flow of exhaust discharged from the outlet 13 of the first exhaust pipe 11 so as to slightly enter the interior of the inlet 14 of the second exhaust pipe 12.

Partitions 16, 17 may be provided in the inlet 14 of the second exhaust pipe 12 and the outlet 13 of the first exhaust pipe 11 may be disposed in proximity to the partitions 16, 17.

One or more embodiments of the invention may also configure the work vehicle so that the partitions 16, 17 are configured to combine and connect to each other at angles other than 90 degrees so that the areas of the four divided regions B1 are not all the same while forming the partitions 16, 17 with point symmetry with respect to the center D1 of the outlet 13 of the first exhaust pipe 11 seen from the direction A1 (see FIG. 2) of the flow of exhaust discharged from the outlet 13 of the first exhaust pipe 11.

(Second Alternative Mode)

The cross-sectional shape of the partitions 16, 17 may be formed in a wedge shape that is ½ of an elongated ellipse instead of a triangular wedge shape.

According to this configuration, the outer surfaces of the partitions 16, 17 are not linear but arcuate in cross section, and therefore it can be expected that the flow of exhaust of the engine 4 along the outer surfaces of the partitions 16, 17 will be smooth.

(Third Alternative Mode)

Figure 7:
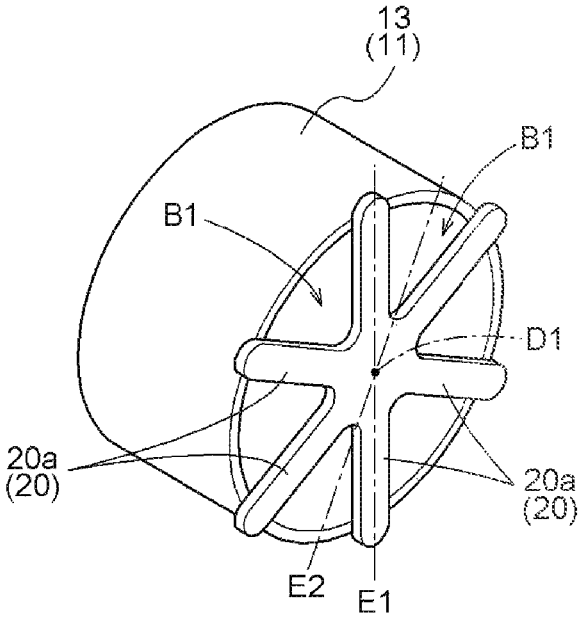
FIG. 7 is a perspective view of the vicinity of an outlet of a first exhaust pipe and partition in a third embodiment of the present invention.

As illustrated in FIG. 7, a partition 20 may be configured by a flat-shaped member or a flat plate and the partition 20 formed so that a plurality of arm portions 20*a* extend radially outward from the center of the outlet 13 of the first exhaust pipe 11 form the center of the partition 20.

In the configuration illustrated in FIG. 7, the arm portions 20*a* of the partition 20 are disposed with point symmetry with respect to the center D1 of the outlet 13 of the first exhaust pipe 11 seen from the direction A1 of the flow of exhaust discharged from the outlet 13 of the first exhaust pipe 11 (see FIG. 2).

When imagining virtual straight lines E1, E2 passing through the center D1 of the outlet 13 of the first exhaust pipe 11 seen from the direction A1 of the flow of exhaust discharged from the outlet 13 of the first exhaust pipe 11 (see FIG. 2), the partition 20 is formed with line symmetry with respect to virtual straight lines E1, E2. The virtual straight line E1 may be imagined so that it passes through a different arm portion 20*a* than the arm portion 20*a* illustrated in FIG. 7 of the partition 20. The virtual straight line E2 may be imagined so that it passes through a different gap of arm portions 20*a* than the gap of arm portions 20*a* illustrated in FIG. 7 of the partition 20.

One divided region B1 is formed by two adjacent arm portions 20*a* of the partition 20 and the peripheral part of the outlet 13 of the first exhaust pipe 11. By setting the angles between adjacent arm portions 20*a* of the partition 20 to be all the same, the areas of the plurality of divided regions B1 are made all the same.

In this case, the number of arm portions 20*a* of the partition 20 is assumed to be 3, 4, 5, and various other numbers. The angles between adjacent arm portions 20*a* of the partition 20 may be set to be different from each other, to configure so that the areas of the plurality of divided regions B1 are not all the same. In addition to the partition 20, a notch part 19 illustrated in FIGS. 4 and 5 may be formed on the outlet 13 of the first exhaust pipe 11.

(Fourth Alternative Mode)

Figure 8:
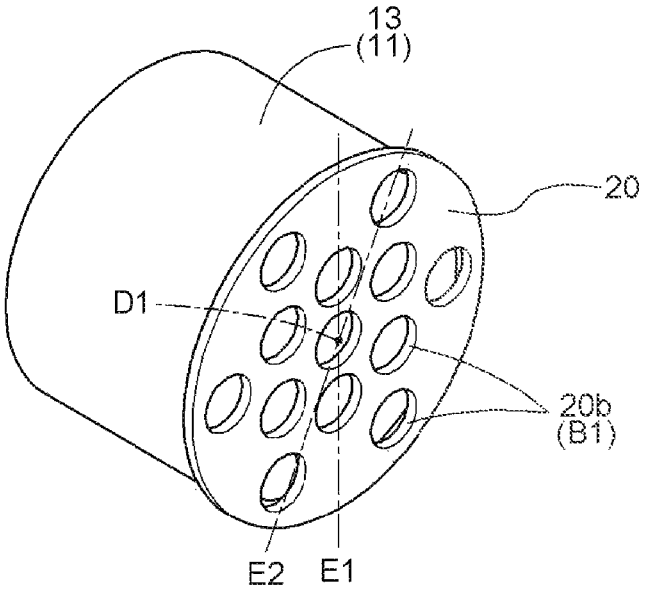
FIG. 8 is a perspective view of the vicinity of an outlet of a first exhaust pipe and partition in a fourth embodiment of the present invention.

As illustrated in FIG. 8, the partition 20 may be configured by a flat-shaped member or a flat plate, and a plurality of circular openings 20*b* of the same inner diameter opened to form the partition 20.

One divided region B1 is formed by one opening 20*b* of the partition 20. Because the openings 20*b* of the partition 20 have the same inner diameter, the areas of the plurality of divided regions B1 are all the same.

In the configuration illustrated in FIG. 8, the openings 20*b* of the partition 20 are disposed with point symmetry with respect to the center D1 of the outlet 13 of the first exhaust pipe 11 seen from the direction A1 of the flow of exhaust discharged from the outlet 13 of the first exhaust pipe 11 (see FIG. 2).

When imagining virtual straight lines E1, E2 passing through the center D1 of the outlet 13 of the first exhaust pipe 11 seen from the direction A1 of the flow of exhaust discharged from the outlet 13 of the first exhaust pipe 11 (see FIG. 2), the partition 20 is formed with line symmetry with respect to virtual straight lines E1, E2. The virtual straight line E1 may be imagined so that it passes through a different inside opening 20*b* than the inside opening 20*b* illustrated in FIG. 8 of the partition 20. The virtual straight line E2 may be imagined so that it passes through a different outside opening 20*b* than the outside opening 20*b* illustrated in FIG. 8 of the partition 20.

In this case, the inner diameters of the plurality of opening 20*b* of the partition 20 may be set to be different from each other to configure so that the areas of the plurality of divided regions B1 are not all the same.

(Fifth Alternative Mode)

Figure 9:
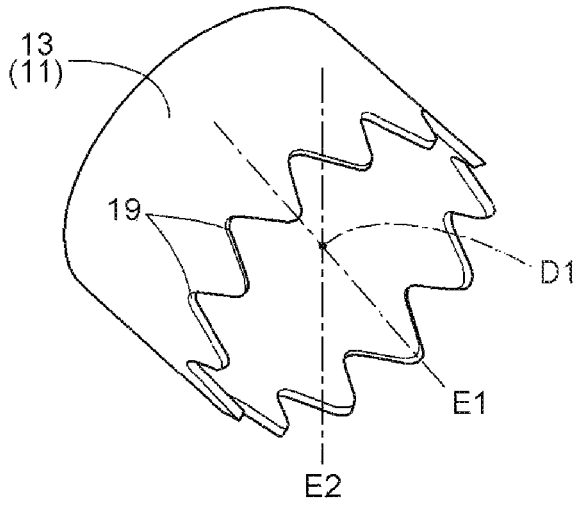
FIG. 9 is a perspective view of the vicinity of an outlet of a first exhaust pipe and notch part in a fifth embodiment of the present invention.

As illustrated in FIG. 9, the partitions 16, 17, 20 may be removed to form a plurality of notch parts 19 across the entire periphery of the peripheral portion of the outlet 13 of the first exhaust pipe 11.

In the plurality of notch parts 19, instead of forming all the notch parts 19 at the same size, the notch parts 19 may be configured so that a mixture of different sizes are present, such as large notch parts 19 and small notch parts 19.

In the configuration illustrated in FIG. 9, the notch parts 19 are formed with point symmetry with respect to the center D1 (see FIGS. 7 and 8) of the outlet 13 of the first exhaust pipe 11 seen from the direction A1 of the flow of exhaust discharged from the outlet 13 of the first exhaust pipe 11 (see FIG. 2).

When imagining virtual straight lines E1, E2 passing through the center D1 of the outlet 13 of the first exhaust pipe 11 seen from the direction A1 of the flow of exhaust discharged from the outlet 13 of the first exhaust pipe 11 (see FIG. 2), the notch parts 19 are formed with line symmetry with respect to virtual straight lines E1, E2.

The virtual straight line E1 may be imagined to that it passes through an end part of the second exhaust pipe 12 side of a different notch part 19 than the notch part 19 illustrated in FIG. 9. The virtual straight line E2 may be imagined to that it passes through the center part of a different notch part 19 than the notch part 19 illustrated in FIG. 9.

Instead of triangular notch parts 19, notch parts 19 of various shapes such as U-shaped, rectangular, and semicircular may be formed, and a mixture of notch parts 19 with different shapes may be configured.

INDUSTRIAL APPLICABILITY

One or more embodiments of the present invention may be applied not only to tractors but also to agricultural work vehicles such as combine harvesters and ridden rice planters, construction work vehicles such as backhoes and wheel loaders, and work vehicles for transporting materials and the like.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A work vehicle comprising:
- a first exhaust pipe to which engine exhaust is sent;
- a second exhaust pipe that has an inlet having an outer diameter larger than an outer diameter of an outlet of the first exhaust pipe, wherein
  - the outlet of the first exhaust pipe and the inlet of the second exhaust pipe are disposed in proximity such that the outlet of the first exhaust pipe is positioned inside the inlet of the second exhaust pipe; and
- a partition that:
  - comprises two or more elongated plates, wherein
    - when viewed from a flow direction of the engine exhaust, the two or more elongated plates either:
      - intersect each other at a center of the outlet of the first exhaust pipe, or
      - extend radially outward from the center of the outlet of the first exhaust pipe, and
    - both end portions of each of the two or more elongated plates are supported by notches on the outlet of the first exhaust pipe, and
  - divides a cross section of the outlet of the first exhaust pipe into a plurality of divided regions when viewed from the flow direction and partitions the adjacent divided regions at intervals.

2. The work vehicle according to claim 1, wherein the partition is attached to the outlet of the first exhaust pipe.

3. The work vehicle according to claim 1, wherein areas of the divided regions are all the same when viewed from the flow direction.

4. The work vehicle according to claim 1, wherein the partition is line symmetrical with respect to a virtual straight line passing through the center of the outlet of the first exhaust pipe when viewed from the flow direction.

5. The work vehicle according to claim 1, wherein a cross section of the partition has a wedge shape when viewed from a direction orthogonal to the flow direction, the wedge shape tapering toward an upstream of a flow of the engine exhaust discharged from the outlet of the first exhaust pipe.

6. The work vehicle according to claim 1, wherein
the notches are V-shaped notches,
each of the two or more elongated plates is folded to have a V-shaped cross section, and
the both end portions of the two or more elongated plates each having the V-shaped cross section are fitted into the V-shaped notches.

7. A work vehicle comprising:
a first exhaust pipe to which engine exhaust is sent;
a second exhaust pipe that has an inlet having an outer diameter larger than an outlet of the first exhaust pipe, wherein
the outlet of the first exhaust pipe and the inlet of the second exhaust pipe are disposed in proximity such that the outlet of the first exhaust pipe is positioned inside the inlet of the second exhaust pipe; and
a partition that comprises two or more elongated plates, wherein
first notches and second notches on the outlet of the first exhaust pipe extend from an end of the outlet of the first exhaust pipe to a direction opposite to the second exhaust pipe, wherein
each of the first notches is larger in size than any of the second notches, and
the first notches support both end portions of each of the two or more elongated plates.

8. The work vehicle according to claim 7, wherein the first and second notches are line symmetrical with respect to a virtual straight line passing through a center of the outlet of the first exhaust pipe when viewed from a flow direction of the engine exhaust.

9. A work vehicle comprising
a first exhaust pipe to which engine exhaust is sent;
a second exhaust pipe that has an inlet having an outer diameter larger than an outlet of the first exhaust pipe, wherein
the outlet of the first exhaust pipe and the inlet of the second exhaust pipe are disposed in proximity such that the outlet of the first exhaust pipe is positioned inside the inlet of the second exhaust pipe; and
a partition that:
comprises two or more elongated plates, wherein
when viewed from a flow direction of the engine exhaust, the two or more elongated plates either:
intersect each other at a center of the outlet of the first exhaust pipe, or
extend radially outward from the center of the outlet of the first exhaust pipe, and
divides a cross section of the outlet of the first exhaust pipe into a plurality of divided regions when viewed from the flow direction and partitions the adjacent divided regions at intervals, wherein
first notches and second notches on the outlet of the first exhaust pipe extend from an end of the outlet of the first exhaust pipe to a direction opposite to the second exhaust pipe, wherein
each of the first notches is larger in size than any of the second notches, and
the first notches support both end portions of each of the two or more elongated plates.

10. The work vehicle according to claim 9, wherein
the partition is attached on the first exhaust pipe across a portion of the first exhaust pipe further separated to a direction opposite to the second exhaust pipe than the ends of the notches in the opposite direction, and the end of the outlet of the first exhaust pipe, and
the partition protrudes from the end of the outlet of the first exhaust pipe toward the second exhaust pipe.

11. The work vehicle according to claim 9, wherein the partition and the first and second notches are line symmetrical with respect to a virtual straight line passing through a center of the outlet of the first exhaust pipe when viewed from the flow direction.

* * * * *